United States Patent [19]

Jadwin et al.

[11] Patent Number: 4,517,272

[45] Date of Patent: May 14, 1985

[54] ELECTROSTATIC DRY TONER COMPOSITION

[75] Inventors: Thomas A. Jadwin, Rochester; Donald S. Rimai, Webster, both of N.Y.

[73] Assignee: Eastman Kodak Company, Rochester, N.Y.

[21] Appl. No.: 522,955

[22] Filed: Aug. 12, 1983

[51] Int. Cl.[3] ..... G03G 9/08

[52] U.S. Cl. ..... 430/110; 430/137

[58] Field of Search ..... 430/110, 137, 111; 521/57, 89

[56] References Cited

U.S. PATENT DOCUMENTS

| | | | |
|---|---|---|---|
| 2,986,521 | 5/1961 | Wielicki | 252/62.1 |
| 3,720,617 | 3/1973 | Chatterji | 252/62.1 |
| 4,110,267 | 8/1978 | Ikeda et al. | 521/89 X |
| 4,155,883 | 5/1979 | Oguchi | 252/62.1 P |
| 4,345,015 | 8/1982 | Hendriksma et al. | 430/110 X |
| 4,430,409 | 2/1984 | Matsumoto et al. | 430/110 X |

FOREIGN PATENT DOCUMENTS

| | | |
|---|---|---|
| 1402010 | 8/1975 | United Kingdom . |
| 1402009 | 8/1975 | United Kingdom . |

OTHER PUBLICATIONS

Patent Abstracts of Japan, 1982; Kokai 57-130048, published Aug. 12, 1982.

Research Disclosure, Aug. 1977, No. 16018, pp. 16-17.

*Primary Examiner*—John Kittle

*Assistant Examiner*—John L. Goodrow

*Attorney, Agent, or Firm*—Bernard D. Wiese

[57] ABSTRACT

The hollow character defect in electrostatically transferred dry toner images is reduced by an electrostatic dry toner composition comprising a binder polymer and a low surface energy liquid such as a silicone oil.

6 Claims, No Drawings

ELECTROSTATIC DRY TONER COMPOSITION

This invention relates to an electrostatic dry toner composition and more particularly to such a composition having improved properties for electrostatic transfer of toner images.

In various well known imaging processes such as electrophotography, dielectric recording and magnetography, developed images of polymer-containing toner powder are transferred electrostatically from one surface to another, for example, from a photo-conductive, dielectric or magnetic surface to a sheet of paper or plastic. The transfer is accomplished by providing an electrostatic attraction of the charged toner particles from the first surface to the second surface which is stronger than the force holding the particles to the first surface. The electrostatic attraction to the second surface can be provided in several known ways, for example, by corona charging of the second surface or by positioning the second surface, e.g., a sheet of paper, between the first surface, e.g., the photo-conductor, and a charged member such as an electrically biased pressure roller or plate. The strength of the field created by the charged roller or plate causes the toner particles to transfer from the first surface, e.g., photoconductor, to the second surface, e.g., paper.

It has been observed that when toner powder comprising, e.g., a pigmented polymer is transferred electrostatically from one surface to another, a character defect can occur in the image. This defect, known as "hollow character" defect, appears in the lines and alphanumeric characters of the developed image. More specifically, the inner portions of the lines and alphanumerics contain little or no toner. Although the defect occurs to some extent even with electrostatic transfer employing corona charging of the second surface, it is especially troublesome when the electrostatic transfer is accomplished by means of a charged pressure member such as a biased pressure roller or plate.

Although it is not intended that the invention be limited by a theoretical explanation, it appears that the hollow character defect is caused by the adhesion of toner particles to each other and to the photoconductor when compressed, thereby impeding the transfer from the photoconductor to paper. The particles appear to compact into large aggregates which pull smaller toner particles away from the interiors of otherwise solid toner areas.

Having discovered a possible cause of the hollow character defect, a novel toner composition is provided in accordance with the present invention which reduces or eliminates the defect. The composition of the invention is a toner composition comprising finely divided, dry binder polymer particles admixed prior to their use as a toner with a liquid of low surface energy in an amount sufficient to eliminate or reduce the hollow character defect. In preferred embodiments the polymer is a thermoplastic polymer and the liquid is a silicone oil.

The invention also provides a novel developer composition comprising the novel toner and a carrier. It further provides methods of preparing and using the toner composition.

The compositions of the invention can be prepared by admixing the toner polymer and low surface energy liquid before of after the toner particles are formed. It is greatly preferred, however, to admix the polymer and the liquid before forming the toner particles.

In addition, the toner particles can be prepared in more than one way; for example, by melt blending of the components, then solidifying and pulverizing the blend, or by spray drying a mixture of the toner polymer and the low surface energy liquid in a common solvent.

The most preferred method of preparation comprises melt blending the toner polymer, which can be a thermoplastic or a thermosetting polymer, with preferred components such as a pigment and a charge control agent and with the low surface energy liquid such as a silicone oil. The blend is then crushed and ground to the desired small particle size. The resulting particles contain the low surface energy liquid in intimate contact with the polymer, some of it being on the surface of the polymeric particles and some being occluded within particles.

The purpose of crushing and grinding of the toner composition is to reduce it to the form of finely divided particles or powder. Particles having an average diameter from about 0.1 to 100 microns are suitable. Although for most uses, e.g., for use in office copying machines employing magnetic brush development, an average diameter for the toner particles from 1.0 to 30 microns is preferred. Larger or smaller particles can be used for particular methods of the electrostatic image development. For example, in powder cloud development, extremely small particle with average diameters of the order of 0.01 microns can be used.

As mentioned above the toner polymer of the compositions of the invention can be either a thermoplastic or a thermosetting polymer although thermoplastic polymers are preferred. The polymer can be selected from many that have been employed or reported in the literature as being useful as dry toner polymers. These include both vinyl and condensation polymers, such as homopolymers and copolymers of styrene, polyesters, polyesteramides, polycarbonates, modified alkyd resins, phenolformaldehyde resins and derivatives thereof, aromatic resins containing alternating methylene and aromatic units as described in Merrill et al, U.S. Pat. No. 3,809,554 and fusible crosslinked resins as disclosed in Jadwin et al, U.S. Pat. No. 3,938,992.

Especially useful toner polymers are styrene-acrylic copolymers of from 40 to 100 percent by weight of styrene or styrene homologs and from 0 to 45 percent by weight of one or more lower alkyl acrylates or methacrylates. Preferred fusible styrene copolymers are those which are covalently crosslinked with a divinyl compound such as divinylbenzene.

Also especially useful are polyesters of aromatic dicarboxylic acids with one or more aliphatic diols, such as polyesters of terephthalic acid with ethylene glycol and cyclohexane dimethanol.

The toner polymers for the compositions of the invention have a glass transition temperature (Tg) in the range from 60° to 120° C. The fusing point is the range from 65° C. to 200° C. so that the toner particles can readily be fused to paper receiving sheets. Preferred are polymers having a fusing point in the range from 65° C. to 120° C. If the toner transfer is made to other types of second surfaces or receiving sheets, such as metal plates, polymers of higher fusing ranges can be used.

As used herein, the term fusing point refers to the melting point of a resin as measured by Fisher Johns apparatus, Fisher Scientific Catalog No. 12-144. Glass transition temperature (Tg) as used herein refers to the temperature at which a polymeric material changes from a glassy polymer to a rubbery polymer. This temperature (Tg) can be measured by differential thermal analysis as disclosed in Techniques and Methods of Polymer Evaluation, Vol. 1, Marcel Dekker, Inc., N.Y. 1966.

The low surface energy liquids for the compositions of the invention are well known and are also called release agents or low sheer materials. When mixed with the toner polymer they form a composition having substantially lower surface energy than the original polymer. Silicone oils are the preferred low-surface energy liquids. Examples of suitable liquids include liquids corresponding to the series of silicone glycol copolymer liquids, alkylaryl silicone liquids, chlorophenylmethyl silicone liquid, dimethyl-silicone liquid and fluorosilane liquids available from Dow Corning Company. Other useful liquids include polyvinylidene fluoride liquids, polymonochlorotrifluoroethylene liquids, hexafluoropropylenevinylidene fluoride copolymers, perfluoroalkyl polyethers (available under such names as Fomblyn and Krytox and sold by Montecatini-Edison and DuPont Company, respectively), fluoroalkyl esters, block copolymers of dimethyl siloxane with a variety of materials such as Bisphenol A, tetramethylspirobi(inda)diol, and the like, e.g. as disclosed in Research Disclosure, August 1977, Item 16018.

As already mentioned, the polymer and low surface energy liquid are mixed before or after forming the toner particles, but preferably before. The amount of such liquid employed is simply the amount that is sufficient to reduce to a satisfactory level or eliminate the hollow character defect in the transferred toner image. The amount should not be so great, however, so as to decrease excessively the adhesion of the toner to the paper or other second surface. Satisfactory amounts of liquid with most toner polymers and with most surface materials are in the range from 0.1 to 5 weight percent based on the total toner weight. Preferably, the amount is from 0.5 to 3 weight percent.

Although the toner polymer and low surface energy liquid are the most essential components of the toner composition of the invention, other components can be included if desired. These include, in particular, colorants such as pigments or dyestuffs and charge control agents. A common pigment is carbon black, although other black or colored colorants can be employed. The colorant can be virtually any of the compounds mentioned in the Colour Index, Vols. 1 and 2, 2nd Edition. The amount of colorant can vary over a wide range, e.g., from about 1 to 20 percent by weight of the toner polymer. Preferably, the amount is from 2 to 10 weight percent.

The charge control agents for the dry toner compositions of the invention can also be selected from a wide range of compounds, including those disclosed, for example, in Jadwin et al, U.S. Pat. No. 4,394,430; Burness et al, U.S. Pat. No. 4,079,014; Jadwin et al, U.S. Pat. No. 3,893,935; and U.K. Pat. No. 1,420,839. Aromatic quaternary ammonium salts are especially useful. The charge agents are used in amounts sufficient to maintain stable, high charge on the toner, e.g., in amounts from about 0.05 to 6 parts, and preferably 0.3 to 2 parts by weight of charge agent per part of toner polymer.

The compositions of the invention will reduce the hollow character defect in electrostatically transferred images for a number of different kinds of transfer techniques. The defect is observed most seriously, however, in charged roller transfer. In that technique the receiver, which is the surface to which the toner image is transferred, passes through a nip between the toned surface of the photoconductor and a biased pressure roller. The roller is biased to a voltage to create a field that causes toner to move from the photoconductor surface to the receiver surface. With that kind of transfer method the compositions of the invention find their greatest utility.

As is well known in the art, electrostatic toner powders usually are employed in a mixture with carrier particles, the mixture being called a developer. One kind of developer is the so-called two-component developer which is a mixture of magnetic or non-magnetic carrier particles and of toner particles, although additional components can be included in two-component developers. Another kind of developer is the single component developer which the developer particle contains both carrier material and toner. The toner can also be used for some purposes as a developer without a carrier, for example, powder cloud development.

The toner compositions of the present invention can be employed in either two component or single component developers and such developers, since they contain the novel toner compositions, are also novel compositions of the invention.

The developer carriers can be magnetic substances such as iron, steel, iron oxide or ferrite particles or particles of other magnetic substances. These developers can be used in the well known magnetic brush method of electrostatic imaging development. For other development methods such as cascade development, non-magnetic substances such as glass or ceramic beads can be used as carriers. The carrier particles can be of substantially larger size than the toner particles although developer compositions of the invention also include those in which the carrier particles are small, e.g., of about the same size as the toner particles. Thus the carrier particles can range in average size from about 5 to 1200 microns, with an average size of 10–300 microns being most useful. Examples of suitable carrier materials and particle sizes are disclosed in a patent to Jadwin et al, U.S. Pat. No. 3,938,992.

A control and the invention are illustrated by the following examples.

CONTROL EXAMPLE

The toner polymer was a vinyl copolymer formed by suspension polymerization of 75 parts by weight of styrene, 25 parts of butyl acrylate and 1.35 parts of divinyl benzene. The polymer had a Tg of 63° C. The vinyl copolymer in the amount of 100 parts by weight was mixed with 6 parts of carbon black (Regal 300) and with 1.5 parts of the charge control agent, benzyldimethyloctadecyl ammonium chloride. The mixture was melt blended on heated compounding rolls at 130°0 C. for 20 minutes. There after the resulting blend was cooled and allowed to solidify and was crushed into coarse particles. It was then pulverized in a fluid energy mill of the type disclosed in Siegel et al, U.S. Pat. No. 4,089,472 to an average particle size of about 12 microns.

EXAMPLES OF THE INVENTION

The procedure of the control example was repeated except that when melt compounding the toner a silicone oil was included in the blend. In one example one part and in another example three parts by weight of Dow Corning DC 200 silicone oil at 350 and at 30,000 centistokes respectively were employed.

The toners of the control example and of the examples of the invention were evaluated in the transfer of an image from an organic photoconductor element charged to 600 volts to a paper sheet, employing a biased roller transfer device. The control example showed substantial hollow character defect. In contrast, the toners of the invention, containing silicone oil, showed little or no hollow character defect. Toner containing as little as one part by weight of low viscosity silicone oil per 100 part of toner showed substantially less hollow character image defect than the control toner composition.

This invention has been described in detail with certain preferred embodiments thereof, but it will be understood that variations and modifications can be effected within the spirit and scope of the invention.

What is claimed is:

1. An electrostatic dry toner composition comprising finely divided polymer particles admixed with a silicone oil.

2. An electrostatic dry developer composition comprising a carrier and a toner composition according to claim 1.

3. An electrostatic dry toner composition according to claim 1 wherein a portion of said oil coats the surfaces of said particles and another portion is occluded within individual polymer particles.

4. A method of preparing electrostatic toner particles which comprises melt blending a toner polymer with a silicone oil and thereafter solidifying and pulverizing the resulting blend.

5. In a method of imaging wherein an electrostatic latent image is formed on a first surface, is developed with a polymeric toner composition and transferred electrostatically to a second surface, the improvement wherein said toner composition comprises finely divided polymer particles and a silicone oil.

6. A method according to claim 5 wherein the first surface is a photoconductive element and the second surface is paper.

* * * * *